US010544954B2

(12) United States Patent
Lazar

(10) Patent No.: US 10,544,954 B2
(45) Date of Patent: Jan. 28, 2020

(54) SYSTEM AND METHOD FOR MONITORING AN ENERGY CONSUMING APPLIANCE

(71) Applicant: Lennox Industries Inc., Richardson, TX (US)

(72) Inventor: Steve Lazar, Fair Oaks Ranch, TX (US)

(73) Assignee: Lennox Industries Inc., Richardson, TX (US)

( * ) Notice: Subject to any disclaimer, the term of this patent is extended or adjusted under 35 U.S.C. 154(b) by 70 days.

(21) Appl. No.: 15/934,702

(22) Filed: Mar. 23, 2018

(65) Prior Publication Data

US 2019/0293317 A1 Sep. 26, 2019

(51) Int. Cl.

| | |
|---|---|
| ***F24F 11/47*** | (2018.01) |
| ***F24F 11/38*** | (2018.01) |
| ***F24F 11/49*** | (2018.01) |
| ***F24F 11/52*** | (2018.01) |
| *G05B 15/02* | (2006.01) |
| *G05B 19/042* | (2006.01) |
| *G05D 23/19* | (2006.01) |

(52) U.S. Cl.

CPC ..... *F24F 11/47* (2018.01); *F24F 11/38* (2018.01); *F24F 11/49* (2018.01); *F24F 11/52* (2018.01)

(58) Field of Classification Search

CPC ..... F24F 11/47; F24F 2140/60; G05B 15/02; G05B 19/042; G05B 2219/2614; G05B 2219/2639; G05D 23/19

USPC ..... 700/276, 291

See application file for complete search history.

(56) References Cited

U.S. PATENT DOCUMENTS

| | | | | |
|---|---|---|---|---|
| 4,858,141 | A | 8/1989 | Hart et al. | |
| 2012/0316984 | A1* | 12/2012 | Glassman | G06Q 10/06 705/26.7 |
| 2014/0324244 | A1* | 10/2014 | Musunuri | G05B 15/02 700/299 |
| 2016/0377309 | A1* | 12/2016 | Abiprojo | G05B 19/042 700/276 |

OTHER PUBLICATIONS

Seeed, "Non-invasive AC Current Sensor (100A max)," https://www.seeedstudio.com/Noninvasive-AC-Current-Sensor-100A-max-p-547.html, downloaded Mar. 23, 2018, pp. 1-5.

Archived Forum, "How to build an Arduino energy monitor—measuring mains voltage and current," https://openenergymonitor.org/emon/node/58, downloaded Mar. 23, 2018, pp. 1-4.

Makonin, S. et al., "Nonintrusive Load Monitoring (NILM) Performance Evaluation : A unified approach for accuracy reporting," Jul. 19, 2015, 8 pages.

Albert, A., "Dissaggregation: Brief Survey," https://peec.stanford.edu/sites/default/files/disaggwkshp_session3_albert.pdf, downloaded Mar. 23, 2018, 16 pages.

* cited by examiner

*Primary Examiner* — Michael J Brown

(74) *Attorney, Agent, or Firm* — Baker Botts L.L.P.

(57) ABSTRACT

A monitoring system includes a heating, ventilation, and air conditioning (HVAC) unit, one or more sensors coupled to the HVAC unit, and a controller. The one or more sensors are operable to detect one or more properties associated with the HVAC unit. The controller is configured to receive the one or more properties from the one or more sensors and determine a first measurement associated with the HVAC unit based on the one or more properties.

17 Claims, 4 Drawing Sheets

SYSTEM AND METHOD FOR MONITORING AN ENERGY CONSUMING APPLIANCE

TECHNICAL FIELD

Certain embodiments of this disclosure relate generally to systems and methods for monitoring an energy consuming appliance, and more specifically, using one or more sensors to monitor an energy consuming appliance (e.g., a heating, ventilation, and air conditioning (HVAC) unit).

BACKGROUND

A building (e.g., an office or a residence), site, or other space may include one or more energy consuming appliances, such as a heating, ventilation, and air conditioning (HVAC) unit, a water heater, a microwave, an oven, and so on. Energy consuming appliances utilize different amounts of energy at different times. Utility companies may charge customers different rates at different times. For example, a utility company may charge a customer a higher than average rate during periods of high demand (e.g., after normal business hours during a heat wave). Accordingly, customers who operate a large appliance (e.g., an HVAC unit) or several large appliances (e.g., an HVAC unit, a water heater, and a washing machine) during periods of high demand may be charged higher than average electricity rates.

SUMMARY OF THE DISCLOSURE

According to one embodiment, a monitoring system includes an HVAC unit, one or more sensors coupled to the HVAC unit, and a controller. The one or more sensors are operable to detect one or more properties associated with the HVAC unit. The controller is configured to receive the one or more properties from the one or more sensors and determine a first measurement associated with the HVAC unit based on the one or more properties.

In particular embodiments, the controller further configured to initiate one or more actions based on the first measurement, the one or more actions including at least one of the following: turning on the HVAC unit, turning off the HVAC unit, and changing a power schedule of the HVAC unit. The one or more properties are electrical current and voltage and the first measurement is a cost associated with power consumption of the HVAC unit.

In particular embodiments, the controller is further configured to determine a second measurement associated with an appliance based on the one or more properties. The second measurement is a cost associated with a power consumption of the appliance. The controller is further configured to initiate one or more actions based on the first measurement and the second measurement. The one or more actions include at least one of the following: turning off the HVAC unit while the appliance is turned on, turning on the HVAC unit while the appliance is turned off, turning off the appliance while the HVAC unit is turned on, and turning on the appliance while the HVAC unit is turned off.

In particular embodiments, the one or more sensors are current sensors coupled to a monitoring device and one or more power lines of the HVAC unit, and the one or more sensors and the monitoring device are located within the HVAC unit.

In particular embodiments, the system further includes a display device configured to receive the first measurement associated with the HVAC unit and display the first measurement to a user of the display device.

In particular embodiments, the controller is further configured to detect fault in the HVAC unit based on the first measurement and determine one or more actions based on the detected fault. The one or more actions include at least one of the following: transmitting a fault alert to a display device and shutting down one or more components of the HVAC unit. The controller is further configured to initiate the one or more actions.

In particular embodiments, the controller is further configured to determine a unique measurement for each appliance of a plurality of appliances. The plurality of appliances including two or more of the following: a dishwasher, a washer, a dryer, an oven, a stove, and a vacuum cleaner.

In particular embodiments, the controller is further configured to initiate one or more actions based on the first measurement being above a predetermined threshold. The first measurement is associated with power consumption of the HVAC unit.

According to another embodiment, a method for monitoring an HVAC unit includes receiving, by a controller, one or more properties from one or more sensors coupled to a heating, ventilation, and air conditioning (HVAC) unit. The one or more properties are associated with the HVAC unit and the one or more properties are detected by the one or more sensors. The method further includes determining, by the controller, a first measurement associated with the HVAC unit based on the one or more properties.

In particular embodiments, the method further includes initiating one or more actions based on the first measurement. The one or more actions include at least one of the following: turning on the HVAC unit, turning off the HVAC unit, and changing a power schedule of the HVAC unit.

In particular embodiments, the method further includes determining a second measurement associated with an appliance based on the one or more properties. The second measurement is a cost associated with a power consumption of the appliance. The method further includes initiating one or more actions based on the first measurement and the second measurement. The one or more actions include at least one of the following: turning off the HVAC unit while the appliance is turned on, turning on the HVAC unit while the appliance is turned off, turning off the appliance while the HVAC unit is turned on, and turning on the appliance while the HVAC unit is turned off.

In particular embodiments, the method further includes receiving, by a display device, the first measurement associated with the HVAC unit, and displaying the measurement to a user of the display device.

In particular embodiments, the method further includes detecting, by the controller, fault in the HVAC unit based on the first measurement and determining, by the controller, one or more actions based on the detected fault. The one or more actions include at least one of the following: transmitting a fault alert to a display device and shutting down one or more components of the HVAC unit. The method further includes initiating the one or more actions.

In particular embodiments, the method further includes determining a unique measurement for each appliance of a plurality of appliances. The plurality of appliances including two or more of the following: a dishwasher, a washer, a dryer, an oven, a stove, and a vacuum cleaner.

According to yet another embodiment, a non-transitory computer readable medium includes instructions for causing processing circuitry to receive, from one or more sensors coupled to an HVAC unit, one or more properties. The one or more sensors are operable to detect one or more properties associated with the HVAC unit. The instructions further cause the processing circuitry to determine a first measurement associated with the HVAC unit based on the one or more properties.

In particular embodiments, the instructions further cause the processing circuitry to initiate one or more actions based on the first measurement. The one or more actions include at least one of the following: turning on the HVAC unit, turning off the HVAC unit, and changing a power schedule of the HVAC unit.

In particular embodiments, the instructions further cause the processing circuitry to determine a second measurement associated with an appliance based on the one or more properties. The second measurement is a cost associated with a power consumption of the appliance. The instructions further cause the processing circuitry to initiate one or more actions based on the first measurement and the second measurement. The one or more actions include at least one of the following: turning off the HVAC unit while the appliance is turned on, turning on the HVAC unit while the appliance is turned off, turning off the appliance while the HVAC unit is turned on, and turning on the appliance while the HVAC unit is turned off.

In particular embodiments, the instructions further cause the processing circuitry to receive the first measurement associated with the HVAC unit and display the first measurement to a user of the display device.

Certain embodiments may provide one or more technical advantages. For example, certain embodiments allow an HVAC system to monitor which energy consuming appliances (e.g., an HVAC unit and/or a washing machine) within a building (e.g., an office or residence) are in operation. By monitoring energy consumption per energy consuming appliance, the HVAC system can manage future operation of energy consuming appliances during peak energy periods, which may assist in reducing a customer's energy costs. For instance, the HVAC system may direct cooling to occupied rooms, thus delivering substantial cost savings and increased user comfort.

As another example, in one or more embodiments, a monitoring device may be installed at the HVAC unit, which mitigates privacy concerns. For instance, the monitoring device may be a stand-alone in-home system under the sole control of a user (e.g., a homeowner) that can provide feedback to the user about energy use without revealing information to an outside party (e.g., a utility company). In certain embodiments, installing the monitoring device at the HVAC unit increases the accuracy of the measurements due to proximity. For instance, installing sensors on the power lines within or near the HVAC unit increases the signal strength generated by the sensors, thereby increasing the accuracy of the energy consuming measurements associated with energy consumption for the HVAC unit.

As another example, one or more embodiments may include a display device (e.g., a thermostat) that displays to a user (e.g., a home owner) which energy consuming devices are currently in operation. For instance, the display device may show the user that certain lights, an entertainment center, an oven, and a refrigerator are all turned on, alerting the user to high energy consumption and providing the user an opportunity to shut down certain energy consuming appliances.

As another example, certain embodiments of the HVAC system may utilize a monitoring device to identify early failures in the HVAC system. For example, a weak or strong signal (as compared to an average signal) generated by one or more sensors coupled to the HVAC unit during operation of an HVAC unit may indicate failure of one or more components of the HVAC system (e.g., a transformer of the HVAC unit or a water heater).

As still another example, certain embodiments may draw connections between an energy consumer's behaviors and energy consumption. These connections may be used to reduce energy consumption, improve efficiency, flatten peak loads, save money, and/or balance appliance use with green energy availability.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 5 of the drawings, like numerals being used for like and corresponding parts of the various drawings.

Buildings (e.g., offices, warehouses, retail, and residences) and other structures often utilize energy consuming appliances to provide an optimal environment. A number of appliances may be placed within a building to provide heating, cooling, lighting, and refrigeration, among other desired functions. For example, a building may include one or more of a heating, ventilation, and air conditioning (HVAC) unit, a water heater, a washing machine, and an oven. Each of these appliances consumes its own unique amount of energy. For example, an HVAC unit may consume more energy during operation than a water heater.

Certain systems may monitor energy consumption by installing a monitoring device at or near an electrical panel. For example, a monitoring device may be installed within a breaker box attached to an outer wall of a residence. Often times, the electrical panel is accessible to external parties (e.g., a utility company). Thus, an external party may monitor activity of a user (e.g., a homeowner) without the user's knowledge, which may jeopardize the user's privacy and/or safety. For example, an external party may access behavioral patterns of a user, such as routine times when the user is away from home or showering. Certain embodiments of the present disclosure may locate the monitoring device within or near an HVAC unit (e.g., within the confines of a building under the sole control of a user), which may mitigate safety and privacy concerns.

Installing a monitoring device in closer proximity to the breaker box than to the appliances (e.g., an HVAC unit) may impair the monitoring device's ability to accurately detect electrical properties of the appliances due to attenuation or interference. Locating the monitoring device within or near the HVAC unit (e.g., in closer proximity to the HVAC unit than to the breaker box) may increase the efficiency of the monitoring system due to the proximity of the monitoring device to the HVAC unit. This disclosure contemplates systems and methods that may provide an efficient solution to monitoring the various appliances that are operating in a particular building while protecting a user's privacy and safety.

Figure 1:
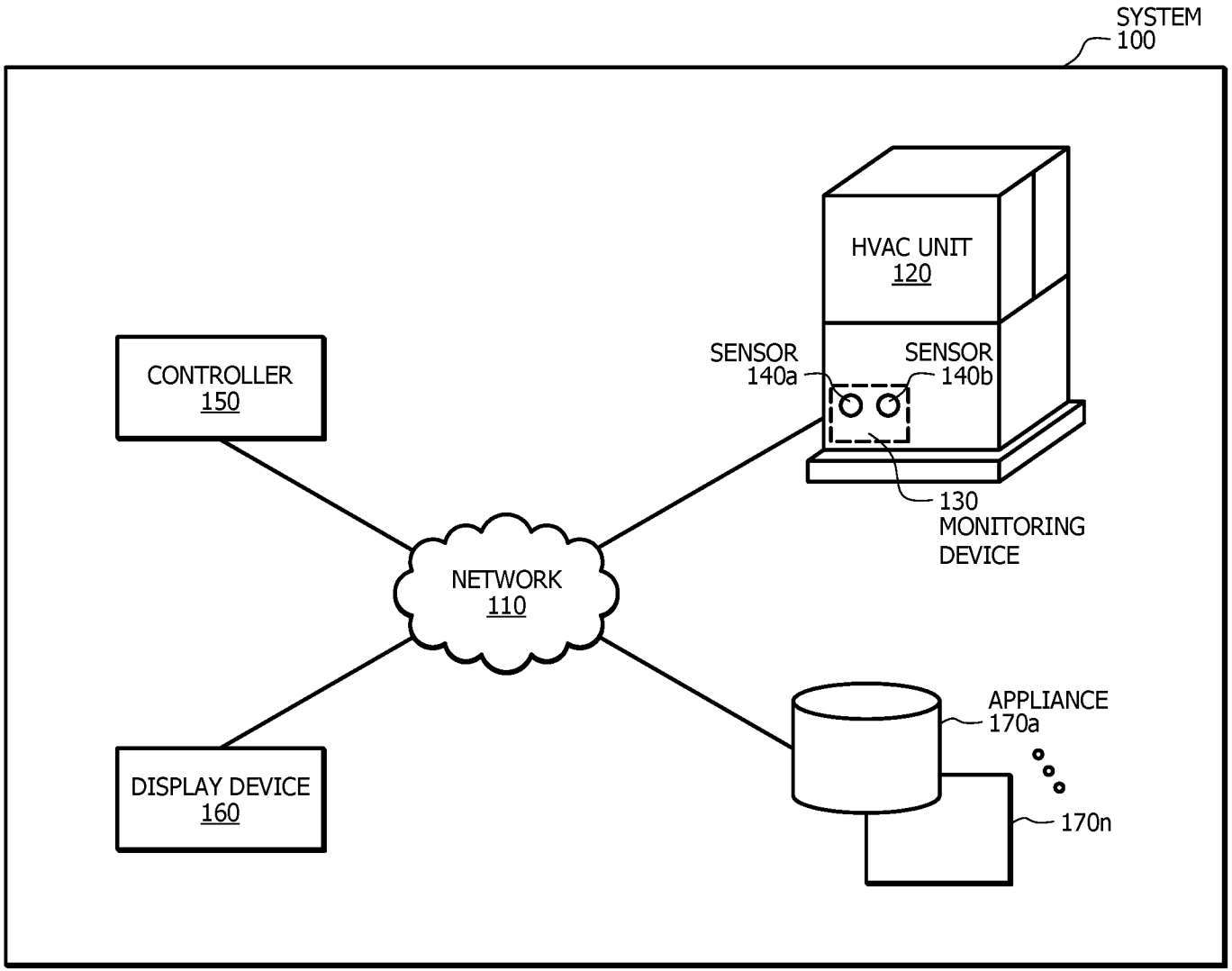
FIG. 1 illustrates an example system including an HVAC unit, a controller, a display device, and appliances, according to certain embodiments.

FIG. 1 illustrates an example monitoring system 100, according to certain embodiments. System 100 includes a network 110, an HVAC unit 120, a monitoring device 130, sensors 140*a* and 140*b*, a controller 150, a display device 160, and one or more appliances 170*a-n*, where n represents any suitable integer.

System 100 or portions thereof may be associated with an entity, which may include any entity, such as a person, business, or company, that monitors energy consuming appliances. Throughout this description, this entity is referred to as the entity associated with system 100. In one embodiment, network 110, HVAC unit 120, monitoring device 130, sensors 140*a* and 140*b*, controller 150, display device 160, and one or more appliances 170*a-n* may be included within an entity and connected by network 110. The elements of system 100 may be implemented using any suitable combination of hardware, firmware, and software.

Although FIG. 1 illustrates a particular arrangement of network 110, HVAC unit 120, monitoring device 130, sensors 140*a* and 140*b*, controller 150, display device 160, and one or more appliances 170*a-n*, this disclosure contemplates any suitable arrangement of network 110, HVAC unit 120, monitoring device 130, sensors 140*a* and 140*b*, controller 150, display device 160, and one or more appliances 170*a-n*. As an example and not by way of limitation, two or more of network 110, HVAC unit 120, monitoring device 130, sensors 140*a* and 140*b*, controller 150, display device 160, and one or more appliances 170*a-n* may be connected to each other directly, bypassing network 110. As another example, two or more of network 110, HVAC unit 120, monitoring device 130, sensors 140*a* and 140*b*, controller 150, display device 160, and one or more appliances 170*a-n* may be physically or logically co-located with each other in whole or in part. As still another example, appliances 170*a-n* may be coupled to the same electrical meter/source as HVAC unit 120, even if appliances 170*a-n* are not part of network 110. Moreover, although FIG. 1 illustrates a particular number of networks 110, HVAC units 120, monitoring devices 130, sensors 140, controllers 150, display devices 160, and appliances 170, this disclosure contemplates any suitable number of networks 110, HVAC units 120, monitoring devices 130, sensors 140, controllers 150, display devices 160, and appliances 170. As an example and not by way of limitation, system 100 may include one or more HVAC units serving different areas of a building.

This disclosure contemplates any suitable network 110. As an example and not by way of limitation, one or more portions of network 110 may include an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, or a combination of two or more of these. Network 110 may include one or more networks 110. Network 110 may be any communications network, such as a private network, a public network, a connection through the internet, a mobile network, a WI-FI network, etc. One or more components of system 100 may communicate over network 100. For example, controller 150 may communicate over network 110, including receiving one or more properties from monitoring device 130 and/or sensors 140*a* and 140*b*. As another example, display device 160 may receive one or more measurements over network 110 from controller 150.

HVAC unit 120 is any unit operable to provide heating, ventilation, and/or air conditioning for system 100. For example, HVAC unit may be an indoor air handler or furnace as conventionally used in residential or commercial applications. In certain embodiments, HVAC unit 120 is an appliance (e.g., appliance 170*a*). One or more power lines provide power to one or more leads physically connected to HVAC unit 120. HVAC unit 120 is discussed in more detail below in FIG. 2.

Monitoring device 130 is any device operable to monitor one or more components of system 100. For example, monitoring device 130 may monitor power consumption of HVAC unit 120 and appliances 170*a-n*. In certain embodiments, monitoring device 130 is physically located within HVAC unit 120. Monitoring device 130 may include one or more controllers 150.

Sensors 140*a* and 140*b* are any sensors operable to detect one or more properties from one or more leads. For example, sensors 140*a* and 140*b* may be operable to detect electrical current and voltage in one or more leads that provide power to HVAC unit 120. In certain embodiments, sensor 140*a* and/or sensor 140*b* are current sensors (e.g., toroid current sensors).

Sensor 140*a* and/or sensor 140*b* may be physically located within HVAC unit 120. In certain embodiments, sensor 140*a* and/or sensor 140*b* couple to the one or more leads that provide power to HVAC unit 120. For example, a first lead of HVAC unit 120 may couple to sensor 140*a*, generating a first magnetic field, and a second lead of HVAC unit 120 may couple to sensor 140*b*, generating a second magnetic field. Sensors 140*a* and/or 140*b* may detect spikes and patterns on the leads (e.g., 220 volt power lines) of HVAC unit 120. In some embodiments, one or more leads may run through a ring (e.g., a circular ring) of sensor 140*a* and/or sensor 140*b*. In some embodiments, sensor 140*a* and/or 140*b* may clamp onto the one or more leads that provide power to HVAC unit 120.

In certain embodiments, sensor 140*a* and/or sensor 140*b* may couple to monitoring device 130. For example, sensor 140*a* may physically attach to monitoring device 130 via a first hard wire connection. Similarly, sensor 140*b* may physically attach to monitoring device 130 via a second hard wire connection. As another example, sensor 140*a* and/or sensor 140*b* may communicate with monitoring device 130 via a WI-FI network. In some embodiments, monitoring device 130 includes sensors 140*a* and 140*b*.

Controller 150 is any controller operable to communicate with one or more components of system 100. In certain embodiments, controller 150 is operable to receive, process, and transmit information. Controller 110 may be communicatively coupled to one or more of network 110, HVAC unit 120, monitoring device 130, sensor 140*a* and/or sensor 140*b*, display device 160, and one or more appliances 170*a-n*. For example, controller 110 may be local to the building at which each of network 110, HVAC unit 120, monitoring device 130, sensor 140*a*, sensor 140*b*, display device 160, and one or more appliances 170*a-n* is located, or may be remote to the location of the building, but coupled to one or more of the systems through a communication link or links. Controller 110 may be configured to receive data from network 110, HVAC unit 120, monitoring device 130, sensor 140*a*, sensor 140*b*, display device 160, and one or more appliances 170*a-n*.

In certain embodiments, controller 150 receives data from sensors 140*a* and/or 140*b*. For example, controller 150 may receive one or more properties (e.g., electrical current and/or voltage) associated with the leads of HVAC unit 120 from sensors 140*a* and/or 140*b*. Controller 150 may use the one or more properties received from sensors 140*a* and/or 140*b* to distinguish between different energy consuming appliances. For example, controller may utilize one or more algorithms to distinguish between power consumption of HVAC unit 120 and one or more appliances 170*a-n*. Over time, controller 150 may learn a unique electronic signature for each energy consuming appliance (e.g., a first electronic signature for HVAC unit 120, a second electronic signature for appliance 170*a*, a third electronic signature for appliance 170*b*, and so on). Controller 150 may utilize the electronic signatures to determine which appliances are currently in operation and which appliances are not operable. In certain embodiments, controller 150 is within the sole control of an entity to mitigate privacy concerns.

Controller 150 may determine a first measurement associated with HVAC unit 120 based on the one or more properties received from sensors 140*a* and 140*b*. For example, controller 150 may determine power consumption of HVAC unit 120 at a specific time of day based on the one or more properties received from sensor 140*a* and/or 140*b*. Controller 150 may then determine a cost associated with the power consumption of HVAC unit 120. As another example, controller 150 may determine a second measurement associated with appliance 170*a* based on the one or more properties received from sensor 140*a* and/or 140*b*. For example, controller 150 may determine power consumption of appliance 170*a* at a specific time of day based on the one or more properties received from sensor 140*a* and/or 140*b*. Controller 150 may then determine a cost associated with the power consumption of appliance 170*a*. Controller 150 may determine a unique measurement for each appliance 170*a-n* in a similar fashion.

In certain embodiments, controller 150 may monitor and control the operation of HVAC unit 120 and appliances 170*a-n* based on one or more measurements. For example, controller 150 may initiate one or more actions based on the first measurement associated with HVAC unit 120. The one or more actions may include turning on HVAC unit 120, turning off HVAC unit 120, and/or changing a power schedule of HVAC unit 120 (e.g., program HVAC unit 120 to operate during specific time periods). As another example, controller may initiate one or more actions based on the first measurement and the second measurement. The one or more actions may include turning off HVAC unit 120 while appliance 170*a* is turned on, turning on HVAC unit 120 while appliance 170*a* is turned off, turning off appliance 170*a* while HVAC unit 120 is turned on, and turning on appliance 170*a* while HVAC unit is turned off.

In some embodiments, controller 150 uses one or more properties received from sensor 140*a* and/or sensor 140*b* for diagnostics. Controller 150 may identify early failures of one or more appliances (e.g., HVAC unit 120 and appliances 170*a-n*) based on the received properties. For example, controller 150 may detect fault in HVAC unit 120 and determine one or more actions based on the detected fault. The one or more actions may include transmitting a fault alert to a user (e.g., a home or business owner) or an external party (e.g., a repair company), shutting down one or more components of HVAC unit 120, and/or displaying the fault alert to the user. Controller 150 may then initiate these one or more actions. In certain embodiments, controller 150 is located within or near HVAC unit 120. In some embodiments, controller may be located within monitoring device 130. Controller 150 is described in more detail in FIG. 3 below.

Display device 160 is any device operable to present information relating to one or more components of system 100. For example, display device 160 may receive a first measurement (e.g., a cost associated with power consumption of HVAC unit 120) from controller 150 and display the first measurement on a display (e.g., a high-definition color display) of display device 160. In certain embodiments, display device 160 is a thermostat. For example, display device 160 may be a smart programmable thermostat. Display device 160 may communicate with one or more components of system 100 via network 110. For example, display device may communicate with monitoring device 130 through a wireless connection of network 110. In certain embodiments, display device 160 includes one or more controllers 150.

Each appliance 170*a-n* is a piece of equipment operable to perform a specific task. For example, appliances 170*a-n* may include one or more of HVAC unit 120, a dishwasher, a washing machine, a dryer, an oven, a stove, a fireplace, a water heater, a refrigerator, a fan, a vacuum cleaner, overhead lighting, and the like.

Figure 2:
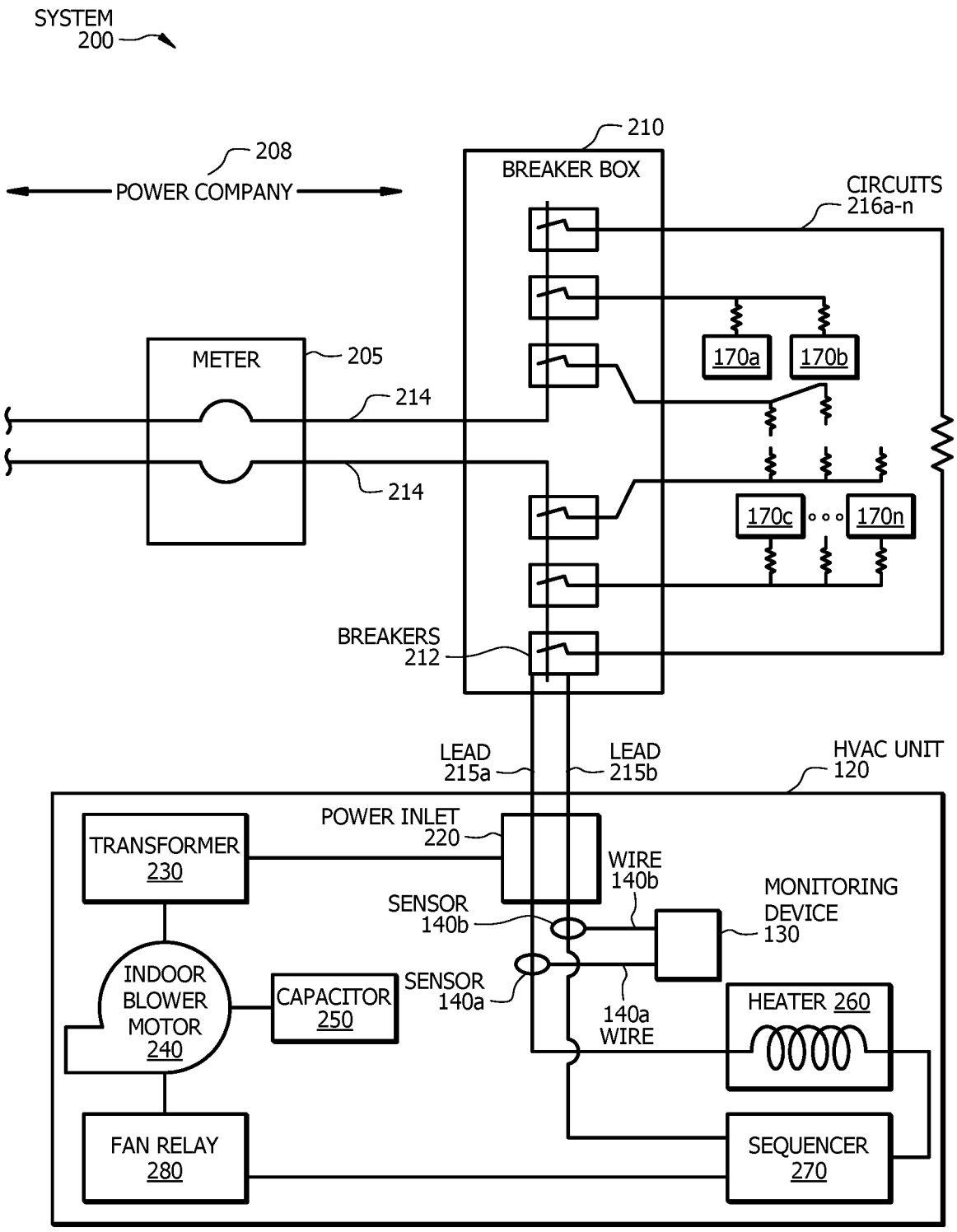
FIG. 2 illustrates an example system including an HVAC unit that may be used in the embodiment of FIG. 1, according to some embodiments.

FIG. 2 illustrates an example system 200 with an HVAC unit 120 that may be used in the embodiment of FIG. 1, according to some embodiments. System 200 includes a meter 205, a breaker box 210 with breakers 212, circuits 216, and HVAC unit 120. Meter 205 is a device that measures energy consumed by an entity (e.g., a residence or business). Meter 205 may be physically located outside the confines of a building. For example, meter 205 may be attached to an exterior side of a building. A power company (e.g., power company 208) may utilize meter 205 for billing purposes. In certain embodiments, main power line(s) 214 run from power company 208 through meter 205 to breaker box 210. In certain embodiments, breaker box 210 is located outside the confines of a building. For example, breaker box 210 may be attached to an exterior side of a building. Breaker box 210 of system 200 receives power from main power line(s) 214 of system 100 and distributes that power to different energy consuming appliances (e.g., HVAC unit 120 and appliances 170*a-n*) via leads (e.g., lead 215*a* and lead 215*b*) and circuits (e.g., circuits 216*a-n*). Leads 215*a* and 215*b* (e.g., 240 volt leads) are physically connected to breaker box 210 to HVAC unit 120. Leads 215*a* and 215*b* provide power to HVAC unit 120 and run parallel with main power line(s) 214. Due to lead 215*a*'s and lead 215*b*'s proximity to main power line(s) 214, signals available at main power line(s) 214 (e.g., signals associated with appliances 170*a-n*) are also available on leads 215*a* and 215*b*.

HVAC unit 120 includes one or more components for operation. For example, HVAC unit 120 may include a power inlet 220, a transformer 230, an indoor blower motor 240, a capacitor 250, a heater 260, a sequencer 270, and a fan relay 280. Transformer 230, indoor blower motor 240, capacitor 250, heater 260, sequencer 270, and fan relay 280. One or more of power inlet 220, transformer 230, indoor blower motor 240, capacitor 250, heater 260, sequencer 270, and fan relay 280 may be physically connected to lead 215*a* and/or lead 215*b* such that power is distributed from lead 215*a* and/or lead 215*b* to transformer 230, indoor blower motor 240, capacitor 250, heater 260, sequencer 270, and/or fan relay 280.

In certain embodiments, power inlet 220 (e.g., a 240 volt power inlet) receives lead 215*a* and/or lead 215*b* from breaker box 210. Sensor 140*a* may be coupled to lead 215*a*, creating a first magnetic field, and sensor 140*b* may be coupled to lead 215*b*, creating a second magnetic field. For example, lead 215*a* may run through an opening of sensor 140*a*, generating the first magnetic field, and lead 215*b* may run through an opening of sensor 140*b*, generating the second magnetic field. Wire 145*a* and wire 145*b* may be coupled (e.g., physically attached) to sensor 140*a* and sensor 140*b*, respectively. Wires 145*a* and 145*b* are also coupled monitoring device 130. The first magnetic field generated by sensor 140*a* and lead 215*a* is coupled to wire 145*a* via inductive coupling. Similarly, the second magnetic field generated by sensor 140*b* and lead 215*b* is coupled to wire 145*b* via inductive coupling. A controller (e.g., controller 150) of monitoring device 130 receives one or more properties (e.g., voltage and/or current) associated with HVAC unit 120 from sensor 140*a* and/or sensor 140*b*. These one or more properties are used to determine a measurement associated with one or more appliances 170*a-n* (e.g., HVAC unit 120). In certain embodiments, the measurement is associated with power consumption of the one or more appliances.

Figure 3:
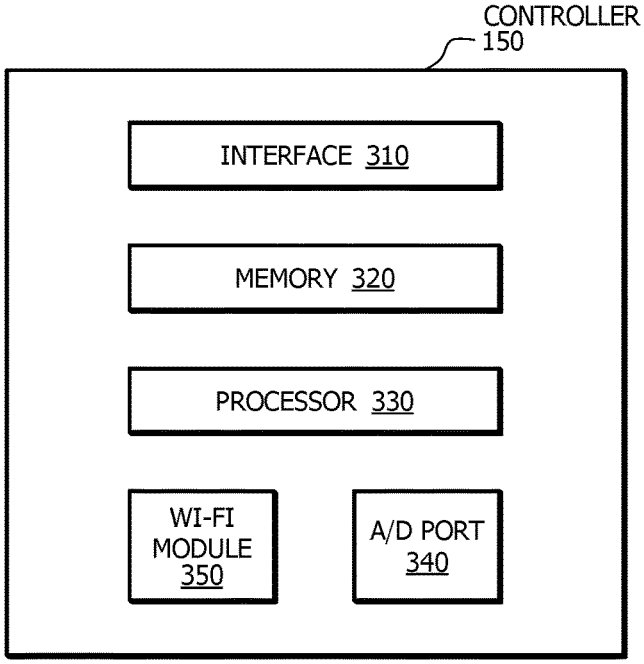
FIG. 3 illustrates an example controller that may be used in the embodiment of FIG. 1, according to certain embodiments.

FIG. 3 is an example controller 150 that may be used in the embodiment of FIG. 1, according to certain embodiments. Controller 150 may include an interface 310, a memory 320, a processor 330, an A/D port 340, and a WI-FI module 350. In some embodiments, controller 150 is a stand-alone device (e.g., a Smart Hub). In certain embodiments, controller 150 is part of another component of system 100. For example, controller 150 may be located within monitoring device 130 and may control operation of monitoring device 130. As another example, controller 150 may be located within display device 160 and may control operation of display device 160. Controller 150 may communicate with other components of system 100 via network 110. For example, controller 150 may be a stand-alone device that communicates via WI-FI with display device 160. In some embodiments, controller 150 may communicate with other components of system 100 via a hard wire connection.

Interface 310 of controller 150 represents any suitable computer element that can receive information, transmit information, perform suitable processing of the information, communicate to other components (e.g., display device 160) of system 100, or any combination of the preceding. For example, interface 310 of controller 150 may receive one or more properties (e.g., electrical current and/or voltage) from sensor 140*a* and/or 140*b* and transmit one or more measurements associated with the one or more properties to display device 160 via network 110. Interface 310 represents any port or connection, real or virtual, including any suitable combination of hardware, firmware, and software, including protocol conversion and data processing capabilities, to communicate through a Local Area Network ("LAN"), Wide Area Network ("WAN"), or other communication system that allows the entity associated with system 100 to exchange information between components of system 100.

Memory 320 of controller 150 stores, permanently and/or temporarily, received and transmitted information, as well as system software, control software, other software for controller 150, and a variety of other information. Memory 320 may store information for execution by processor 330. For example, memory 320 may store one or more algorithms that disaggregate whole house power consumption into individual end use power consumption (e.g., power consumption for HVAC unit 120). As another example, memory 320 may store one or more applications that determine unique signatures (e.g., electric signatures) for each appliance 170*a-n*.

Memory 320 includes any one or a combination of volatile or non-volatile local or remote devices suitable for storing information. For example, memory 320 may include Random Access Memory ("RAM"), Read-only Memory ("ROM"), magnetic storage devices, optical storage devices, or any other suitable information storage device or a combination of these devices. Memory 320 may include any suitable information for use in the operation of controller 150. Additionally, memory 320 may be a component external to (or may be partially external to) controller 150. For example, memory 320 may be a cloud database. Memory 320 may be located at any location suitable for memory 320 to communicate with controller 150.

Processor 330 of controller 150 controls certain operations of controller 150 by processing information received from interface 210 and memory 320 or otherwise accessed by processor 330. Processor 320 communicatively couples to interface 210 and memory 320. Processor 330 includes any hardware and/or software that operates to control and process information. Processor 330 may be a programmable logic device, a microcontroller, a microprocessor, any suitable processing device, or any suitable combination of the preceding. Additionally, processor 330 may be a component external to controller 150. Processor 330 may be located in any location suitable for processor 330 to communicate with controller 150. Processor 330 controls the operation of controller 150.

In certain embodiments, processor 330 accesses information from memory 320, processes and analyzes the accessed information, and arranges this information for display on display device 160. For example, processor 330 may access one or more properties (e.g., current and/or voltage) from memory 320, determine a measurement (e.g., power consumption of HVAC unit 120) based on the one or more properties, and arrange this measurement for display on display device 160. As another example, processor 330 may access measurements (e.g., costs associated with power consumption of appliances 170*a-n*) from a memory of monitoring device 130 and arrange these measurements for display on display device 160. As still another example, processor 330 may access one or more properties (e.g., current and/or voltage) and one or more algorithms from memory 320 and determine signatures for HVAC unit 120 and/or appliances 170*a-n* based on the one or more properties and the one or more algorithms.

Analog to digital (A/D) port 340 of controller 150 is any port operable to receive analog voltage values. For example, A/D port 340 may receive analog voltage values from sensors 140*a* and/or 140*b*, and processor 320 of controller 150 may convert the received analog voltage values to digital values (e.g., binary numbers). In certain embodiments, controller 150 may include more than one A/D port 340.

WI-FI module 350 of controller 150 is any module operable to connect to system 100's network 110 via a WI-FI connection. For example, WI-FI module 350 may connect controller 250 (e.g., a Smart Hub) to display device 160 (e.g., a thermostat). In certain embodiments, WI-FI module 350 is operable to connect to a user's mobile device. For example, WI-FI module 350 may connect to a user's mobile phone while remaining connected to system 100's network 110.

Figure 4:
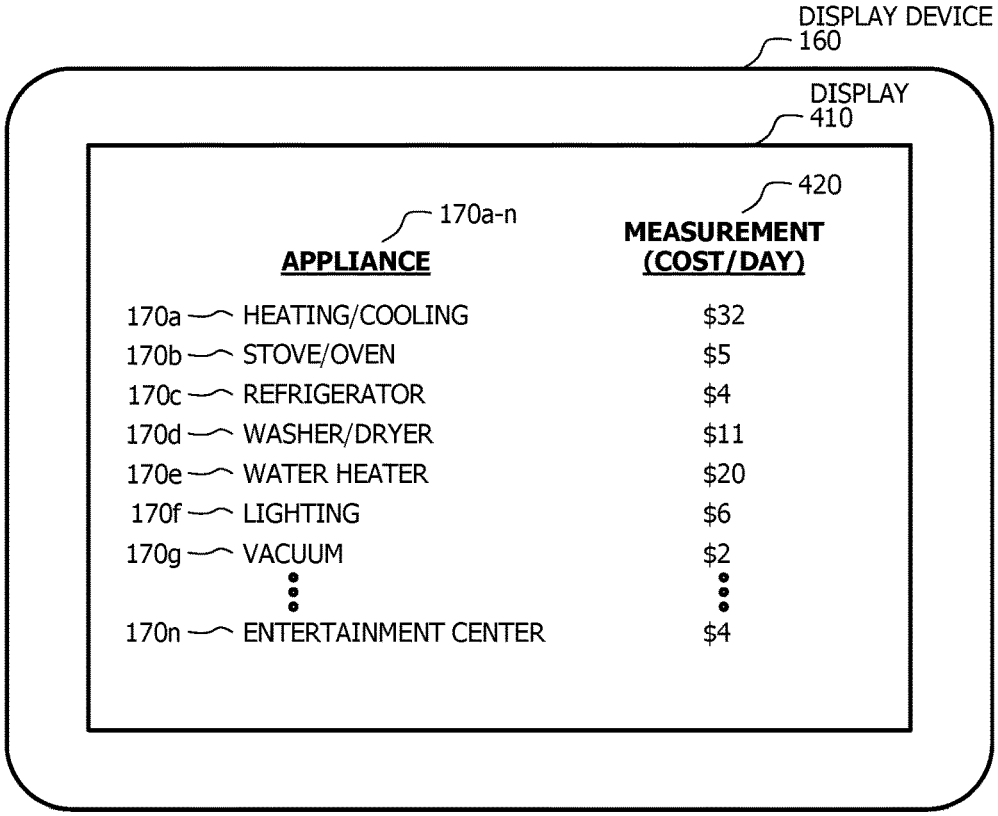
FIG. 4 illustrates an example display device that may be used in the embodiment of FIG. 1, according to certain embodiments.

FIG. 4 illustrates an example display device 160 that may be used in the embodiment of FIG. 1, according to certain embodiments. Display device 160 is any electronic device that includes a display 410 operable to visually present data (e.g., one or more measurements). In some embodiments, display device 160 is a thermostat (e.g., a programmable thermostat) with a color display. Display 410 of display device 160 may visually present data in any format. For example, display 410 may present data in a list format, a graph format, and/or a chart format.

In the illustrated embodiment, display 410 of display device 160 displays a list of appliances 170*a-n* and corresponding measurements 420. Measurements 420 may be displayed in any units. For example, measurements 420 may be displayed as a cost per day of power consumption associated with each appliance 170*a-n*. In the illustrated embodiment, appliance 170*a* is displayed as "heating/cooling" with an associated cost per day of $32, appliance 170*b* is displayed as "stove/oven" with an associated cost per day of $5, appliance 170*c* is displayed as "refrigerator" with an associated cost per day of $4, appliance 170*d* is displayed as "washer/dryer" with an associated cost per day of $11, appliance 170*e* is displayed as "water heater" with an associated cost per day of $20, appliance 170*f* is displayed as "lighting" with an associated cost per day of $6, appliance 170*g* is displayed as "vacuum" with an associated cost per day of $2, and so on, until appliance 170*n*, which is displayed as "entertainment center" with an associated cost per day of $4.

While display 410 of the illustrated embodiment shows a list of appliances 170*a-n* and cost per day of power consumed by the appliances, display 410 may present any visual representation of data associated with one or more components of system 100. For example, the list presented in display 410 may also present power consumption (e.g., voltage, amperage, frequency, and/or elapsed time of usage) for each appliance. As another example, the list presented in display 410 may indicate which appliances 170*a-n* are currently in operation. In certain embodiments, display 410 may present information indicating a potential failure of one or more appliances 170*a-n*. For example, display 410 may present the following statement to alert a user of potential failure of HVAC unit 120: "HVAC unit 120 in need of repair. Please contact service provider."

In certain embodiments, display device 160 receives data from controller 150. For example, display device 160 may receive one or more measurements from controller 150. As another example, display device may receive one or more notifications (e.g., a fault notification) from controller 150. Controller 150 may be external or internal to display device 160. For example, controller 150 may be a part of display device 160.

Figure 5:
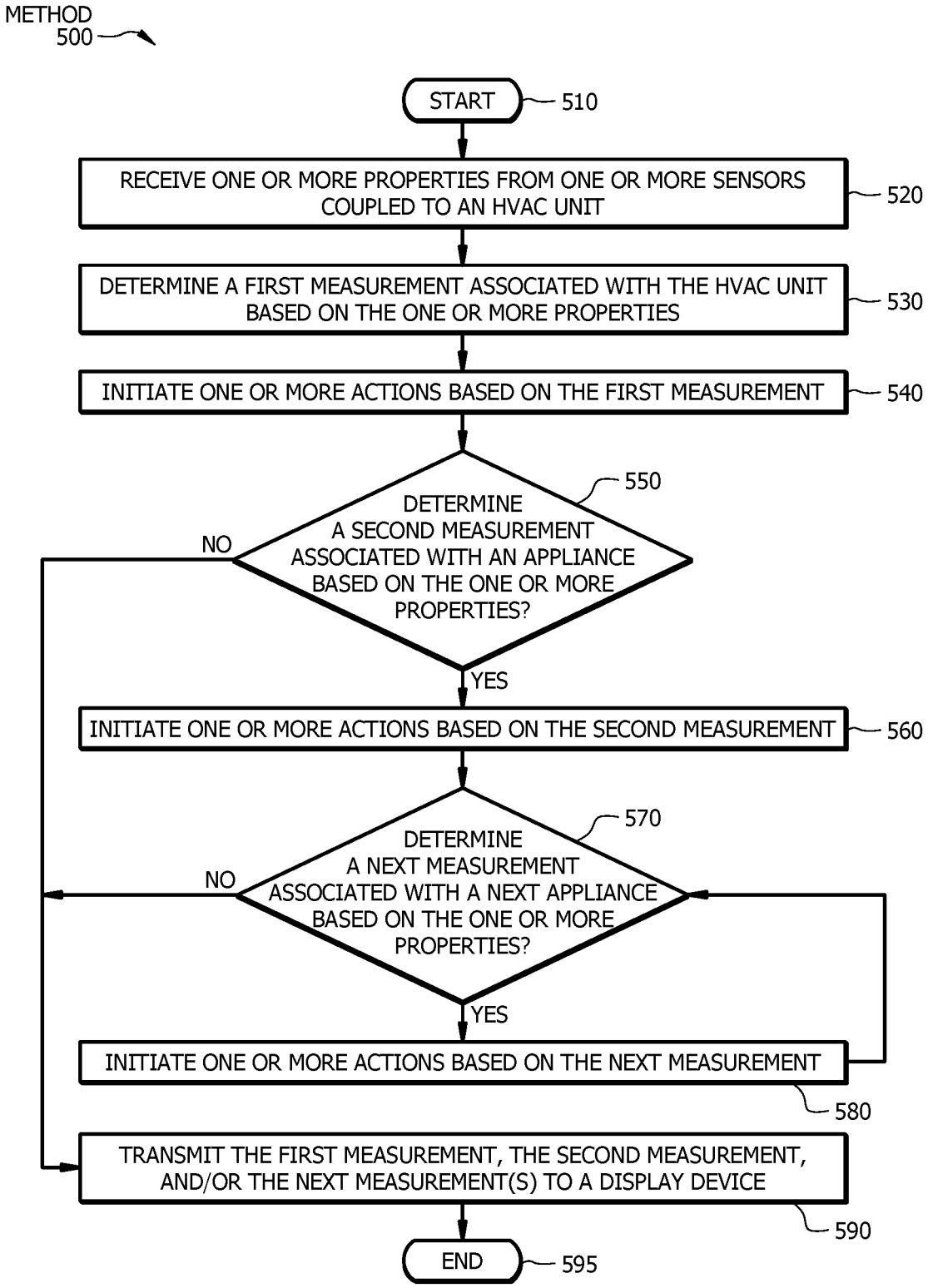
FIG. 5 is a flowchart diagram of an example method for monitoring energy consuming appliances, according to certain embodiments.

FIG. 5 is a flowchart diagram of an example method 500 for monitoring energy consuming appliances, according to certain embodiments. In some embodiments, method 500 begins at step 510. Method 500 then proceeds to step 520, where a controller (e.g., controller 150) receives one or more properties from one or more sensors (e.g., sensors 140*a* and 140*b*) coupled to an HVAC unit (e.g., HVAC unit 120). In certain embodiments, the one or more properties are electrical current and voltage and the sensors are current sensors. In some embodiments, the controller is located within the HVAC unit. For example, the controller may be part of a monitoring device (e.g., monitoring device 130) and may be physically attached to the sensors. In some embodiments, the controller is located external to the HVAC unit.

At step 530, the controller determines a first measurement (e.g., a cost of power consumption) associated with the HVAC unit based on the one or more properties. For example, the controller may access the one or more properties, determine a whole house power consumption based on the one or more properties, and disaggregate the whole house power consumption using one or more algorithms. In certain embodiments, the disaggregated power consumption represents power consumption for each individual power consuming component of a system. For example, the controller may determine a unique power consumption for the HVAC unit and each individual appliance using one or more algorithms. The controller may determine and/or associate unique signatures for each appliance (including HVAC unit 120). In some embodiments, the controller determines the first measurement using the disaggregated power consumption representative of the power consumption of the HVAC unit.

In certain embodiments, the controller can detect fault in the HVAC unit based on the first measurement. For example, the controller may determine that one or more components (e.g., transformer 230) of the HVAC is malfunctioning by comparing the first measurement representative of power consumption of the HVAC unit to previous measurements of the HVAC unit during normal operation.

Method 500 then proceeds to step 540, where the controller initiates one or more actions based on the first measurement. The actions may include turning on the HVAC unit, turning off the HVAC unit, and/or changing a power schedule of the HVAC unit. For example, the controller may turn off the HVAC unit upon determining that the first measurement (e.g., a daily cost of power consumption for the HVAC unit) is at or above a predetermined threshold (e.g., $20). As another example, the controller may turn on the HVAC unit upon determining that the first measurement (e.g., a daily cost of power consumption for the HVAC unit) is below a predetermined threshold (e.g., $20). As still another example, the controller may change the power schedule of the HVAC unit to prevent operation during peak demand hours once the first measurement exceeds a predetermined threshold. In certain embodiments, the controller may direct heating and/or cooling to occupied rooms based on the one or more measurements.

In certain embodiments, the controller determines a fault in an appliance (e.g., an HVAC unit) and initiates one or more actions based on the detected fault. The one or more actions may include transmitting a fault alert to a display device and/or shutting down one or more appliances (e.g., one or more components of the HVAC unit). In some embodiments, controller may transmit a fault alert to an entity (e.g., a repair service provider or a manufacturer).

At step 550, the controller determines whether a second measurement is associated with an appliance (e.g., appliance 170*b*) based on the one or more properties. For example, the controller may determine a second measurement associated with an oven that is consuming power based on the one or more properties. If the controller does not determine a second measurement, then method 500 moves to step 590, where the first measurement is transmitted, by the controller, to a display device. If the controller does determine a second measurement, method 500 advances to step 560.

At step 560, the controller initiates one or more actions based on the second measurement. The actions may include turning on the appliance, turning off the appliance, and/or changing a power schedule of the appliance. For example, the controller may turn off the appliance upon determining that the second measurement (e.g., a daily cost of power consumption for the appliance) is at or above a predetermined threshold (e.g., $5). In certain embodiments, the controller initiates the one or more actions based on more than one measurement (e.g., the first and second measurements). For example, the controller may turn on/off the HVAC unit while the appliance is turned on/off.

Method 500 then advances to step 570, where the controller determines whether a next measurement is associated with a next appliance (e.g., appliance 170*c*) based on the one or more properties. For example, the controller may determine a third measurement associated with refrigerator that is consuming power based on the one or more properties. If the controller does not determine a next measurement, then method 500 moves to step 590, where the controller transmits the first and second measurements to a display device. If the controller does determine a next measurement, method 500 advances to step 580.

At step 580, the controller initiates one or more actions based on the next measurement. The actions may include turning on the appliance, turning off the appliance, and/or changing a power schedule of the appliance. In certain embodiments, the controller initiates the one or more actions based on more than one measurement (e.g., the second and third measurements). For example, the controller may turn on/off appliance 170*b* while appliance 170*c* is turned on/off.

Method 500 then loops back to step 570, where the controller determines whether a next measurement is associated with a next appliance (e.g., appliance 170*d*) based on the one or more properties. Method 500 loops back until the controller determines all measurements associated with power consumption of appliances 170*a-n*. In certain embodiments, the number of measurements determined by controller equals the number of appliances (including HVAC unit 120) currently consuming power. Once the controller determines all measurements associated with power consumption of appliances 170*a-n*, method 500 advances to step 590, where the measurements are transmitted to the display device. Method 500 then proceeds to step 595, where method 500 ends.

Particular embodiments may repeat one or more steps of the method of FIG. 5, where appropriate. Although this disclosure describes and illustrates particular steps of the method of FIG. 5 as occurring in a particular order, this disclosure contemplates any suitable steps of the method of FIG. 5 occurring in any suitable order. Moreover, although this disclosure describes and illustrates an example method for monitoring energy consuming appliances including the particular steps of the method of FIG. 5, this disclosure contemplates any suitable method for monitoring energy consuming appliances including any suitable steps, which may include all, some, or none of the steps of the method of FIG. 5, where appropriate. Furthermore, although this disclosure describes and illustrates particular components, devices, or systems carrying out particular steps of the method of FIG. 5, this disclosure contemplates any suitable combination of any suitable components, devices, or systems carrying out any suitable steps of the method of FIG. 5.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicant notes that it does not intend any of the appended claims to invoke 35 U.S.C. § 112(f) as it exists on the date of filing hereof unless the words "means for" or "step for" are explicitly used in the particular claim.

What is claimed is:

1. A monitoring system, comprising:

a heating, ventilation, and air conditioning (HVAC) unit;

one or more sensors coupled to the HVAC unit, wherein the one or more sensors are operable to detect one or more properties associated with the HVAC unit; and a controller, wherein the controller is configured to:

receive the one or more properties from the one or more sensors;

determine a first measurement associated with the HVAC unit based on the one or more properties;

determine a second measurement associated with an appliance based on the one or more properties, wherein the second measurement is a cost associated with a power consumption of the appliance; and initiate one or more actions based on the first measurement and the second measurement, the one or more actions comprising at least one of the following:

turning off the HVAC unit while the appliance is turned on;

turning on the HVAC unit while the appliance is turned off;

turning off the appliance while the HVAC unit is turned on; and turning on the appliance while the HVAC unit is turned off.

2. The monitoring system of claim 1, wherein:

the one or more properties are electrical current and voltage;

the first measurement is a cost associated with power consumption of the HVAC unit; and the controller is further configured to change a power schedule of the HVAC unit based on the first measurement.

3. The monitoring system of claim 1, wherein:

the one or more sensors are current sensors coupled to a monitoring device and one or more power lines of the HVAC unit; and the one or more sensors and the monitoring device are located within the HVAC unit.

4. The monitoring system of claim 1, the system further comprising:

a display device configured to:

receive the first measurement associated with the HVAC unit; and display the first measurement to a user of the display device.

5. The monitoring system of claim 1, wherein the controller is further configured to:

detect fault in the HVAC unit based on the first measurement;

determine one or more actions based on the detected fault, the one or more actions comprising at least one of the following:

transmitting a fault alert to a display device; and shutting down one or more components of the HVAC unit; and initiate the one or more actions.

6. The monitoring system of claim 1, wherein the controller is further configured to determine a unique measurement for each appliance of a plurality of appliances, the plurality of appliances including two or more of the following:

a dishwasher;

a washer;

a dryer;

an oven;

a stove; and a vacuum cleaner.

7. The monitoring system of claim 1, wherein the first measurement is associated with power consumption of the HVAC unit and the controller is further configured to initiate one or more actions based on the first measurement being above a predetermined threshold.

8. A method for monitoring an HVAC unit, comprising:

receiving, by a controller, one or more properties from one or more sensors coupled to a heating, ventilation, and air conditioning (HVAC) unit, the one or more properties associated with the HVAC unit, the one or more properties detected by the one or more sensors;

determining, by the controller, a first measurement associated with the HVAC unit based on the one or more properties;

determining a second measurement associated with an appliance based on the one or more properties, wherein the second measurement is a cost associated with a power consumption of the appliance; and initiating one or more actions based on the first measurement and the second measurement, the one or more actions comprising at least one of the following:

turning off the HVAC unit while the appliance is turned on;

turning on the HVAC unit while the appliance is turned off;

turning off the appliance while the HVAC unit is turned on; and turning on the appliance while the HVAC unit is turned off.

9. The method of claim 8, wherein:

the one or more properties are electrical current and voltage; and the first measurement is a cost associated with power consumption of the HVAC unit;

the method further comprising changing a power schedule of the HVAC unit based on the first measurement.

10. The method of claim 8, wherein:

the one or more sensors are current sensors coupled to a monitoring device and one or more power lines of the HVAC unit; and the one or more sensors and the monitoring device are located within the HVAC unit.

11. The method of claim 8, further comprising:

receiving, by a display device, the first measurement associated with the HVAC unit; and displaying the measurement to a user of the display device.

12. The method of claim 8, further comprising:

detecting, by the controller, fault in the HVAC unit based on the first measurement;

determining, by the controller, one or more actions based on the detected fault, the one or more actions comprising at least one of the following:

transmitting a fault alert to a display device; and shutting down one or more components of the HVAC unit; and initiating the one or more actions.

13. The method of claim 8, further comprising determining a unique measurement for each appliance of a plurality of appliances, the plurality of appliances including two or more of the following:

a dishwasher;

a washer;

a dryer;

an oven;

a stove; and a vacuum cleaner.

14. A non-transitory computer readable medium comprising instructions for causing processing circuitry to:

receive, from one or more sensors coupled to a heating, ventilation, and air conditioning (HVAC) unit, one or more properties, wherein the one or more sensors are operable to detect one or more properties associated with the HVAC unit;

determine a first measurement associated with the HVAC unit based on the one or more properties;

determine a second measurement associated with an appliance based on the one or more properties, wherein the second measurement is a cost associated with a power consumption of the appliance; and initiate one or more actions based on the first measurement and the second measurement, the one or more actions comprising at least one of the following:

turning off the HVAC unit while the appliance is turned on;

turning on the HVAC unit while the appliance is turned off;

turning off the appliance while the HVAC unit is turned on; and turning on the appliance while the HVAC unit is turned off.

15. The computer readable medium of claim 14, wherein:

the one or more properties are electrical current and voltage;

the first measurement is a cost associated with power consumption of the HVAC unit; and the instructions further cause the processing circuitry to change a power schedule of the HVAC unit based on the first measurement.

16. The computer readable medium of claim 14, wherein:

the one or more sensors are current sensors coupled to a monitoring device and one or more power lines of the HVAC unit; and the one or more sensors and the monitoring device are located within the HVAC unit.

17. The computer readable medium of claim 14, wherein the instructions further cause the processing circuitry to:

receive the first measurement associated with the HVAC unit; and display the first measurement to a user of the display device.

* * * * *